United States Patent [19]

Klappert

[11] 3,955,264

[45] May 11, 1976

[54] CORE STEEL STACKING MACHINE

[76] Inventor: Willi Klappert, 9005 Alcosta Blvd., Apt. 205, San Ramon, Calif. 94583

[22] Filed: July 18, 1975

[21] Appl. No.: 597,196

[52] U.S. Cl. ..... 29/203 L; 29/609; 214/6 F; 214/6 N; 214/8.5 H

[51] Int. Cl.[2] ..... H01F 41/02

[58] Field of Search ..... 29/203 L, 606, 609; 214/6 F, 6 N, 8.5 G, 8.5 H

[56] References Cited

UNITED STATES PATENTS

| | | | |
|---|---|---|---|
| 3,805,982 | 4/1974 | Tolf et al. | 214/1 Q |
| 3,818,587 | 6/1974 | Williams | 29/203 L |
| 3,827,576 | 8/1974 | Ward, Jr. et al. | 214/6 D |

*Primary Examiner*—Carl E. Hall
*Attorney, Agent, or Firm*—Francis X. Doyle

[57] ABSTRACT

A core steel stacking machine for stacking cut core lamination members with a uniform stagger or offset. The cut core laminations are transferred one at a time from a pack of cut laminations and placed on a transfer table which is indexed after each lamination to provide a uniform stagger or offset between the ends of adjacent core laminations.

5 Claims, 3 Drawing Figures

CORE STEEL STACKING MACHINE

BACKGROUND OF THE INVENTION

This invention relates to magnetic cores and more particularly, to a machine for stacking the laminations of a magnetic core to provide a uniform stagger or offset.

As is well-known to those skilled in the magnetic core art, such as for example, the cores used in electrical magnetic induction apparatus, it is common to utilize a number of layers of electric grade magnetic core steel laminations which are formed to the desired shape of the core. In general, two methods are utilized in making such cores. The first method comprises the precutting of a sufficient number of separate laminations of appropriately increased length to form the desired core then stacking such laminations and finally forming them into the desired core. The second method generally comprises winding a single strip of magnetic material about a mandrel to form a roll or core having the desired number of laminations. The core is then cut and thereafter the cut laminations are offset to form the desired core. In most instances, the electromagnetic apparatus generally has a preformed coil and the core is cut and laced about the coil, in what is termed — a lacing operation.

Also as is well-known to those skilled in the art, in making a magnetic core which is cut and placed around an electromagnetic coil it is necessary to offset or stagger the ends of the cut laminations from each other such that, the core losses will be reduced to a minimum. One example of such an offset core is found in U.S. Pat. No. 3,186,067, which issued June 1, 1965.

As is well-known to those skilled i- the art and is shown, for example by the above-mentioned U.S. Pat. No. 3,186,067, it is extremely difficult to provide a uniform overlapping of the cut ends of cores so as to minimize losses in the core as it is formed about the electromagnetic coil. Many different methods have been provided for offsetting the ends of the core laminations and it is to this particular field that this invention is addressed.

SUMMARY OF THE INVENTION

Briefly in one form, this invention provides a core steel stacking machine in which the cut laminations forming a core are placed flat wise on a bed and are then placed in a substantially uniform stack. Each core lamination is transferred to a movable table, one at a time, utilizing a magnetic pickup. As the laminations are transferred to the movable table, the table is indexed for each lamination such that, as the various laminations are stacked one on top of another on the movable table, the ends of the adjacent laminations are offset a predetermined amount due to the indexing of the movable table. After a sufficient number of laminations have been stacked on the movable table they may be moved to a second table for formation into the desired core or they may be transferred to a holding table until sufficient numbers of laminations have been stacked, at which time all of the laminations may be transferred then to a coreforming station.

The invention which is sought to be protected will be clearly pointed out and distinctly claimed in the claims appended hereto. However, it is believed that this invention and the manner in which its objects and advantages are obtained, as well as other objects and advantages thereof will be better understood from the following detailed description of a preferred embodiment, especially when considered in connection with the accompanying drawings.

DESCRIPTION OF PREFERRED EMBODIMENT OF THE INVENTION

As earlier noted, the invention of this application relates to a core steel stacking machine, which is used for stacking core laminations so as to provide the desired offset between the various ends of the laminations which are then later formed into magnetic cores for electromagnetic induction apparatus. The invention will be described in detail with reference to the drawings appended hereto, wherein like numerals will be used to indicate like parts throughout the various views thereof.

Figure 2:
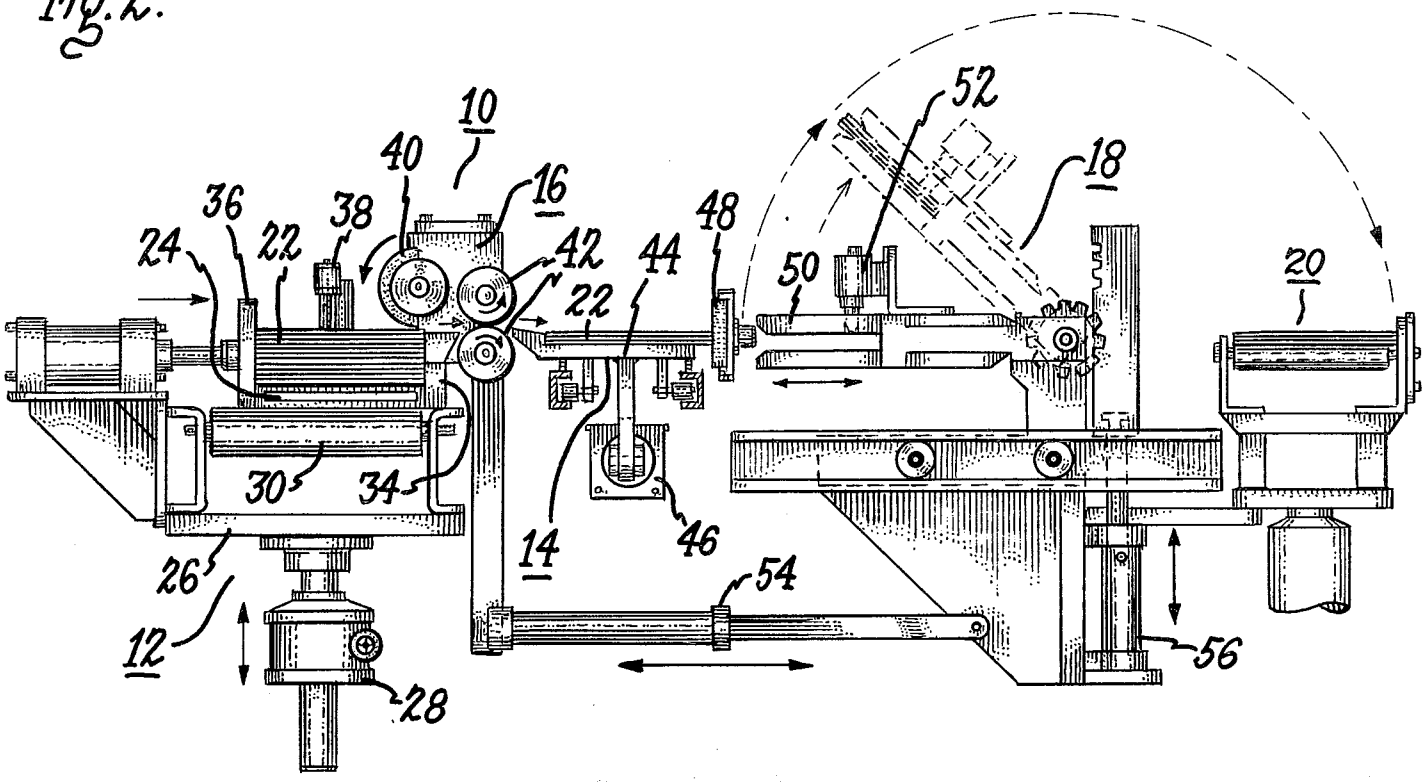
FIG. 2 is a side view of the machine shown in FIG. 1 showing the preferred form of the machine and indicating the schematic operation of the machine according to this invention.

Referring first to FIG. 2, for a brief review of the invention, it may be seen that the core stacking machine 10 is provided with a stacking table 12 on which the core laminations are stacked. A transfer table 14 is also provided, which is an indexing table as will be more fully described hereafter, to which the core steel laminations are transferred by means of the transfer mechanism 16. After a number of core laminations have been indexed appropriately on the transfer table 14, a clamping device 18 picks up the stacked laminations and moves them to a holding table 20. After sufficient laminations to form the desired core have been moved to the holding table 20, the laminations are formed into the desired core, for example by the method disclosed in U.S. Pat. No. 3,186,067.

Figure 1:
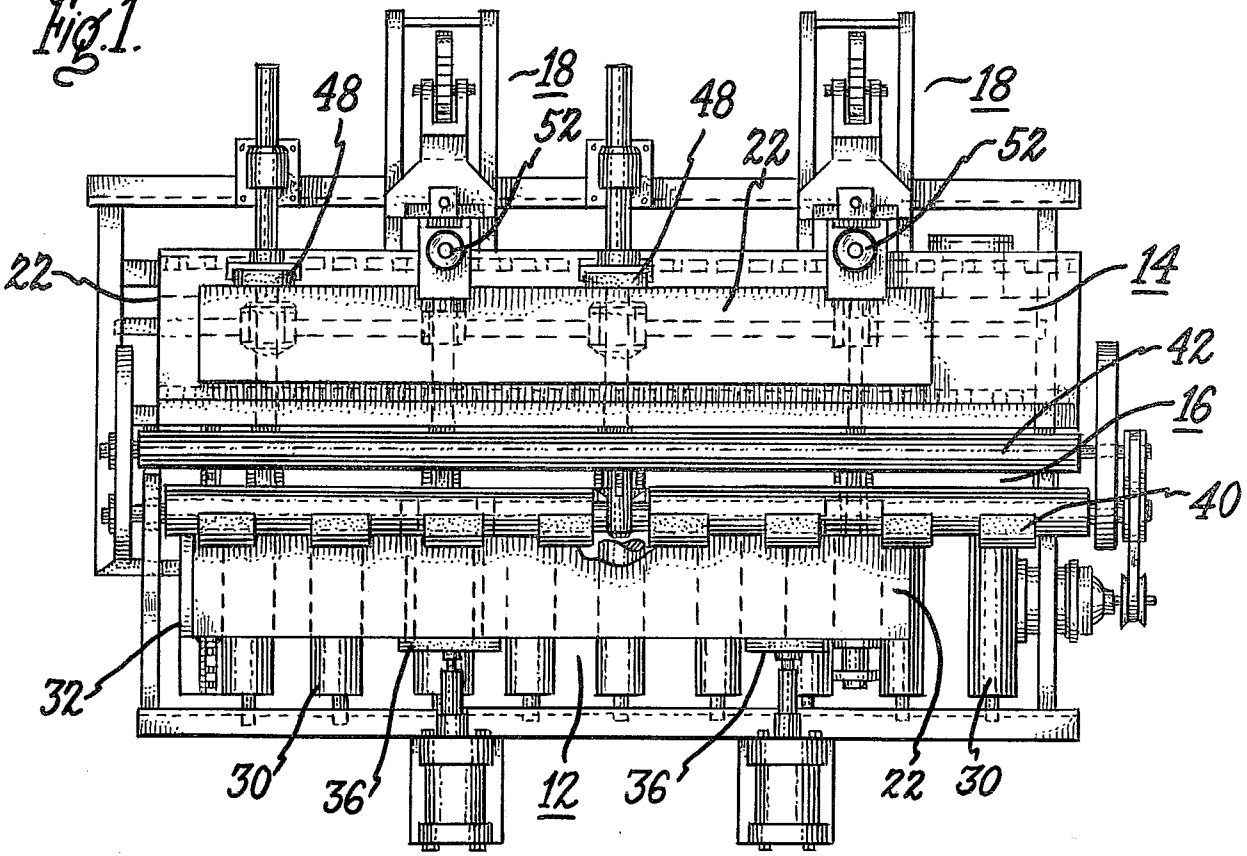
FIG. 1 is a top view of a preferred form of the core steel stacking machine according to this invention.
Figure 3:
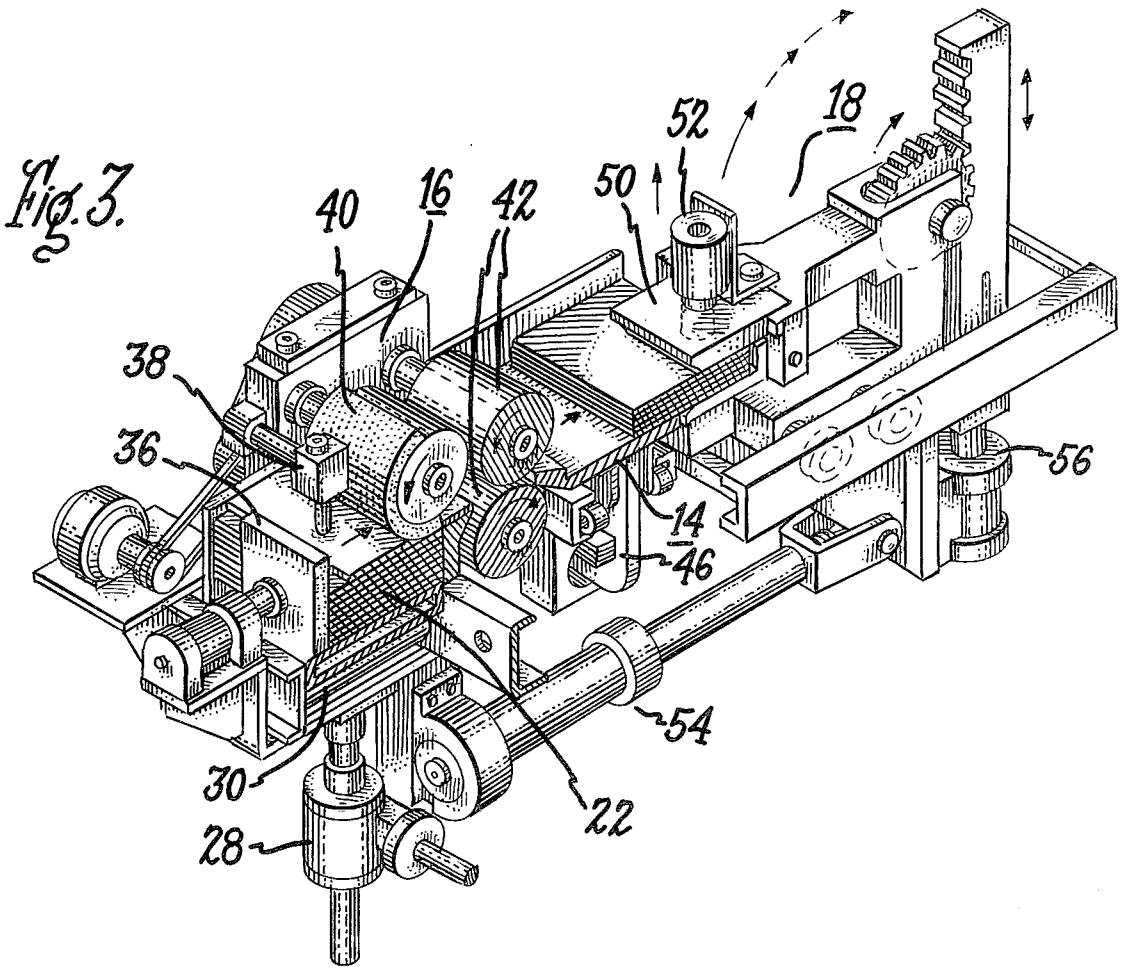
FIG. 3 is a perspective view of the preferred form shown in FIGS. 1 and 2 with portions broken away and in section to more clearly show the operation of the machine.

Referring now to FIGS. 1, 2 and 3, for a more detailed description of the invention of this application, a stack of cut core laminations 22 are moved, preferably by means of a conveyor (not shown), to the part of the machine referred to as stacking table 12. As will be noted, particularly from FIG. 2, the cut core laminations 22 are preferably stacked on a pallet 24. The stacking table 12 includes the base 26 mounted on an automatic lifting device, such as a screw jactuator 28. Also included are rollers 30, a stop member 32, side members 34 and the cylinder actuated members 36. As will be understood the laminations 22 on the pallet 24 roll along rollers 30 until they hit stop 32. Then, the members 36 are actuated to push the laminations 22 against side 34, evening the laminations. The screw jactuator is then actuated to raise table 12 until the top of the stack laminations 22 engage the proximity switch 38.

The transfer mechanism 16 includes a plurality of magnetic rolls 40 and the transfer rolls 42. The magnetic rolls 40, rotating in a counterclock wise direction, as indicated, pick up the top lamination from the core lamination stack 22 and feeds it to the transfer rolls 42. The transfer rolls 42 drive the lamination to the transfer table 14.

The transfer table 14 includes the table base 44, and indexing mechanism 46 and the rubber faced holding members 48. When the separate laminations are driven on table base 44, they butt against the holding members 48. As each separate lamination is placed on base 44, the indexing mechanism 46 indexes the base 44 a predetermined distance. Then, when the next lamination is placed on base 44 on top of the previous lamination, the ends of the lamination are offset or staggered with respect to each other the same distance as the movement of table base 44. In the preferred embodiment, the indexing of table base 44 is provided by each revolution of the magnetic rolls 40. Also, in the preferred embodiment a counter is provided (not shown) such that after each packet, (for example, six laminations) has been placed on the transfer table 14, the packet is moved to a holding table 20. The clamping device 18 includes the jaws 50 which are opened and closed by a cylinder 52. A second cylinder 54 moves the clamping device 18 into the transfer table 14, allowing the jaws 52 to grip the laminations on the table base 44. Then, the cylinder 56 rotates the clamping device 18, as indicated by the dotted line, to place the laminations on the holding table 20.

From what has been said before, it is believed obvious the manner in which the core steel stacking machine of this invention operates. The cores placed on the stacking table 12 are moved upward by the jactuator 28 until the top lamination of stack 22 engages proximity switch 38. At this point, laminations are fed one at a time by means of the magnetic rolls 40 and drive rolls 42 to the transfer table 14. After a predetermined number of laminations, for example, three have been removed from the stack 22, the proximity switch 38 again opens and the jactuator 28 moves the stack laminations and the stacking table 12 again upward until the proximity switch 38 is again engaged. Then, three more laminations will be fed individually by means of the magnetic rolls 40 and driving rolls 42 to the transfer table 14. As will be evident, after the desired number of laminations to form a packet have been stacked on the transfer table 12 with their ends offset as desired, the packet will be removed as earlier indicated and the stacking machine will stack another packet of laminations on table 14. Of course it will be clear, that when the desired number of packets have been placed on table 20 then they will be moved to a forming machine where the packets will be formed into the desired core.

While there has been shown and described the present preferred embodiment of this invention, it will of course be apparent to those skilled in the art that various changes may be made in the use of the different devices without departing from the spirit and scope of the invention, particularly as it is set forth in the appended claims.

What is claimed as new and which it is desired to secure by Letters Patent of the United States is:

1. A magnetic core steel stacking machine comprising a. a stacking table for receiving a plurality of cut core laminations, 1. an automatic lifting device for raising such stacking table to a transfer mechanism, b. said transfer mechanism including a magnetic roll for removing the top lamination from said plurality of cut core laminations on said stacking table, c. a transfer table for receiving individual laminations from said transfer mechanism 1. said transfer table having indexing means for indexing said transfer table a predetermined distance after receiving each individual lamination, whereby the ends of adjacent laminations on said transfer table are offset from each other the same distance as said predetermined index distance.

2. A magnetic core steel stacking machine as claimed in claim 1 in which said indexing means is indexed said predetermined distance for each revolution of said magnetic roll.

3. A magnetic core steel stacking machine comprising a. a stacking table for receiving a plurality of cut core laminations, 1. an automatic lifting device for raising such stacking table to a transfer mechanism, 2. a proximity switch for limiting movement of said lifting device, b. said transfer mechanism including a magnetic roll for removing the top lamination from said plurality of cut core laminations on said stacking table, c. a transfer table for receiving individual laminations from said transfer mechanism 1. said transfer table having indexing means for indexing said transfer table a predetermined distance after receiving each individual lamination, whereby the ends of adjacent laminations on said transfer table are offset from each other the same distance as said predetermined index distance.

4. A magnetic core steel stacking machine as claimed in claim 3 in which said proximity switch is effective to actuate said lifting device after a predetermined number of said cut core laminations have been removed from said plurality of cut core laminations.

5. A magnetic core steel stacking machine as claimed in claim 3 in which a clamping and pick-up device is provided, said clamping and pick-up device acting to remove a packet of laminations from said transfer table and move them to a holding table.

* * * * *